US007381301B2

(12) United States Patent
Wittkopf

(10) Patent No.: US 7,381,301 B2
(45) Date of Patent: Jun. 3, 2008

(54) DEVICE AND WORKING METHOD FOR AUTOMATICALLY CHANGING THE WORK ROLLS, THE BACK-UP ROLLS AND THE INTERMEDIATE ROLLS OF A SINGLE-STAND OR MULTIPLE-STAND STRIP MILL

(75) Inventor: Reinhard Wittkopf, Hemer (DE)

(73) Assignee: SMS Demag AG, Düsseldorf (DE)

( * ) Notice: Subject to any disclaimer, the term of this patent is extended or adjusted under 35 U.S.C. 154(b) by 449 days.

(21) Appl. No.: 10/485,425

(22) PCT Filed: Jul. 26, 2002

(86) PCT No.: PCT/DE02/02808

§ 371 (c)(1),
(2), (4) Date: Jan. 30, 2004

(87) PCT Pub. No.: WO03/015948

PCT Pub. Date: Feb. 27, 2003

(65) Prior Publication Data

US 2004/0231389 A1 Nov. 25, 2004

(30) Foreign Application Priority Data

Aug. 6, 2001 (DE) ..... 101 38 589

(51) Int. Cl.
*D21F 1/32* (2006.01)

(52) U.S. Cl. ..... 162/199; 162/272; 72/238; 72/239; 72/237; 72/245; 414/560; 414/589

(58) Field of Classification Search ..... 162/199, 162/272; 72/238, 239, 237, 225, 245; 414/560, 414/589

See application file for complete search history.

(56) References Cited

U.S. PATENT DOCUMENTS

| | | | |
|---|---|---|---|
| 3,638,468 A | 2/1972 | Fukui et al. | |
| 4,435,970 A | 3/1984 | Sekiya | |

FOREIGN PATENT DOCUMENTS

| | | | |
|---|---|---|---|
| DE | 39 30 125 | | 3/1991 |
| DE | 3930125 | * | 3/1991 |
| DE | 198 15 029 | | 10/1999 |
| DE | 19815029 | * | 10/1999 |
| JP | 55-036063 | * | 3/1980 |
| JP | 56-084108 | | 7/1981 |
| JP | 63-174708 | | 7/1988 |
| JP | S63-174708 | * | 7/1988 |
| JP | 02-187208 | | 7/1990 |

* cited by examiner

*Primary Examiner*—Mark Halpern
(74) *Attorney, Agent, or Firm*—Cohen Pontani Lieberman & Pavane LLP

(57) ABSTRACT

A roll changing carriage can be displaced transversely with respect to the strip rolling stand and a removal crossbar is provided for the removal of the set of backup rolls. In order to shorten the roll changing times and to automate the changing of the rolls, the removal crossbar can be positioned on the roll changing carriage and is provided with wheels on which the removal crossbar can be moved out of the roll changing carriage on guide rails running parallel to the rolls into the strip rolling stand on the intermediate roll rails, and can be pulled out of the strip rolling stand together with the set of backup rolls.

3 Claims, 3 Drawing Sheets

DEVICE AND WORKING METHOD FOR AUTOMATICALLY CHANGING THE WORK ROLLS, THE BACK-UP ROLLS AND THE INTERMEDIATE ROLLS OF A SINGLE-STAND OR MULTIPLE-STAND STRIP MILL

PRIORITY CLAIM

This is a U.S. national stage of application No. PCT/DE02/02808, filed on 26 Jul. 2002. Priority is claimed on that application and on the following application: Country: Germany, Application No.: 101 38 589.7, Filed: 6 Aug. 2001.

BACKGROUND OF TILE INVENTION

1. Field of the Invention

The invention relates to a device and a working method for automatically changing the sets of rolls comprising work rolls, backup rolls and intermediate rolls of a single-stand or multi-stand strip rolling mill, by means of at least one roll changing carriage which can be displaced transversely with respect to the rolling stand into a changing position in line with the center of the strip stand. The carriage receives the sets of rolls that can be pulled out on guide rails running parallel to the rolls and displaces them transversely into a set-up position, in which the replacement with a new set of rolls takes place. A removal crossbar that supports the upper backup roll is provided for the removal of the set of backup rolls, which removal crossbar is supported on the lower backup roll when the work rolls and intermediate rolls have been removed and can be pulled out from the rolling stand together with the set of backup rolls.

2. Description of the Related Art

With the rolling stand, and as a result the entire rolling mill, at a standstill, there is of course a stoppage of production. This is particularly unfavorable if, upstream or downstream of the rolling mill, there are other plants, for example a pickling plant, which could actually continue running. The aim of each roll changing method is therefore to keep the downtimes of the rolling mill as low as possible.

In German Offenlegungsschrift DE 198 15 029 there is a description of a roll changing method for a rolling stand of a multi-stand strip rolling mill, the rolling stands of which have work rolls and backup rolls. After completing the rolling of a first metal strip, the rolling stand is stopped and the work rolls are removed. If the rolling stand has intermediate rolls, the intermediate rolls are preferably removed and installed together with the work rolls.

The backup rolls of this known strip rolling mill are changed with the aid of a removal crossbar in the form of a slotted backup roll changing frame, which is moved into the stand after removal of the set of work rolls. The work is largely carried out manually.

Another method and device for changing the work rolls and backup rolls of a strip rolling stand are described in DE 39 30 125 C2. Here, the changing of the rolls is performed to convert the rolling stand for example from a six-roll system, that is a rolling stand with work rolls, intermediate rolls and backup rolls, into a four-roll system, with work rolls and backup rolls. For removal of the sets of rolls, roll changing carriages which can be moved transversely with respect to the rolling stand and are equipped with guide rails and running rails for the removable sets of rolls are used. At least FIG. 4 of the drawing of this document shows the removal of the backup rolls with the aid of a removal crossbar which rests on the lower backup roll and supports the upper backup roll.

While the changing of the work rolls and also the intermediate rolls proceeds in a largely automated manner, in that, with the aid of the roll changing carriage and the corresponding pulling-out device, the sets of rolls are pulled out of the rolling stand onto the roll changing carriage, where they are brought into a replacement position by transverse displacement, the changing of the backup rolls largely takes place manually. The removal crossbar is brought between the backup rolls with the aid of a crane, the upper backup roll is set down onto the removal crossbar resting on the lower backup roll and the set of backup rolls is moved out on guide rails under the chocks of the lower backup roll. A large number of manual activities during the changing of the backup rolls and crane work require a long downtime of the rolling mill. In addition, the crane work is more dangerous than the automatic changing of the work rolls and/or intermediate rolls.

SUMMARY OF THE INVENTION

The aim of the present invention is to include also the previously manually performed changing of the backup rolls at least partly in the automated roll changing procedure and to use a corresponding device to provide a method for automatically changing the sets of rolls comprising work rolls, backup rolls and intermediate rolls of a single-stand or multi-stand strip rolling mill with which the roll changing times can be reduced and the safety during roll changing can be increased.

To achieve the object, an improved device of the type described at the beginning is proposed, wherein the removal crossbar can be positioned on the roll changing carriage provided for the changing of the work rolls and intermediate rolls and is provided with wheels on which the removal crossbar can be moved out of the roll changing carriage into the strip rolling stand on guide rails running parallel to the rolls and can be pulled out of the strip rolling stand together with the set of backup rolls.

The interaction of the roll changing carriage with the removal crossbar of the set of backup rolls and the special design of the removal crossbar with its own wheels makes it possible for the changing of the backup rolls to be included in the automatic procedure. On the one hand, the provision of the removal crossbar on the roll changing carriage shortens the roll changing time and makes crane work unnecessary, on the other hand the wheels on the removal crossbar make it possible for the removal crossbar to be moved out of and into the roll changing carriage and out of and into the strip rolling stand.

According to a favorable feature of the invention, it is provided that the wheels of the removal crossbar are mounted on both sides in the upper region of the latter and roll in the strip rolling stand on the raisable and lowerable intermediate roll rails of the upper intermediate roll. This allows the removal crossbar to be displaced from the changing carriage on guide rails of the same height directly onto the raisable and lowerable intermediate roll rails positioned in the upper position, from where they can be set down on the lower backup roll or the chock of the latter by lowering the intermediate roll rails. Together with the placed-on upper backup roll, the set of backup rolls can then be moved out from the strip rolling stand manually or in an automated manner, the wheels of the removal crossbar being free and the moving out taking place on the guide rails underneath the chocks of the lower backup roll.

The removal crossbar is advantageously provided with a roll pin, which can be coupled to the pulling-out device of the roll changing carriage.

If, according to a further feature of the invention, it is provided that the removal crossbar can be positioned laterally next to the set of work rolls and intermediate rolls on the roll changing carriage and, by transverse displacement of the roll changing carriage, can be brought into a position in relation to the strip rolling stand in which the guide rails of the roll changing carriage are in line with the raised intermediate roll rails in the strip rolling stand, this proposal also serves for shortening the roll changing times. The removal crossbar no longer needs to be laboriously inserted into the strip rolling stand with the aid of a crane; it is ready-suspended in the roll changing carriage and only needs to be displaced by transverse displacement of the roll changing carriage into the position in which the guide rails on which the wheels of the removal crossbar roll are in line with the intermediate roll rails.

With the device according to the invention, the working method of the invention which comprises the sequence of the following working steps can be carried out:

The rolling stand is hydraulically opened up by opening the roll gap. The roll changing carriage is moved to the center of the stand on rails running laterally next to the strip rolling stand, parallel to the direction of rolling, so that the work rolls and intermediate rolls can be coupled to the pulling-out device and pulled into the roll changing carriage. Together with the work rolls and intermediate rolls, the roll changing carriage is then transversely displaced, the removal crossbar that is provided laterally of the work rolls and intermediate rolls on the roll changing carriage being simultaneously brought into the center of the stand by transverse displacement of the roll changing carriage, so that the guide rails and intermediate roll rails are in line.

The removal crossbar is moved out of the roll changing carriage on its wheels and, guided on the intermediate roll rails, is moved into the strip rolling stand. As soon as the removal crossbar has reached its position in the strip rolling stand, the intermediate roll rails are lowered, whereby the removal crossbar is set down on the lower backup roll or the chock of the latter. Then, by lowering the intermediate roll rails, the upper backup roll can be set down on the removal crossbar. During these working steps, the roll changing carriage with the work rolls and intermediate rolls is transversely displaced, whereby the work rolls and intermediate rolls reach a replacement position, from which they can be replaced with new sets of rolls by the crane. The set of backup rolls supported in the meantime on the removal crossbar is moved out from the strip rolling stand on guide rails and replaced by crane with a new set of backup rolls, which is moved into the strip rolling stand.

At the same time as the changing of the backup rolls, new work rolls and intermediate rolls were placed in the roll changing carriage.

The upper backup roll of the set of rolls and the intermediate roll rails are raised again, the intermediate roll rails engaging under the wheels of the removal crossbar and lifting the latter off the lower backup roll. The roll changing carriage then moves into position and pulls the removal crossbar on the intermediate roll rails out onto the guide rails of the roll changing carriage. By subsequent transverse displacement of the roll changing carriage, the new set of work rolls and intermediate rolls is brought into the center of the stand and pushed into the stand. After closing the roll gap, the changing of the work rolls, intermediate rolls and backup rolls is complete.

With the invention, the downtimes of the rolling mill are shortened considerably. The greater availability of the rolling mill that is consequently achieved increases the output and consequently improves the cost-effectiveness. The automatic feeding of the removal crossbar is additionally much safer for the operating personnel in comparison with the conventional working practice.

DETAILED DESCRIPTION OF THE PRESENTLY PREFERRED EMBODIMENTS

Figure 1:
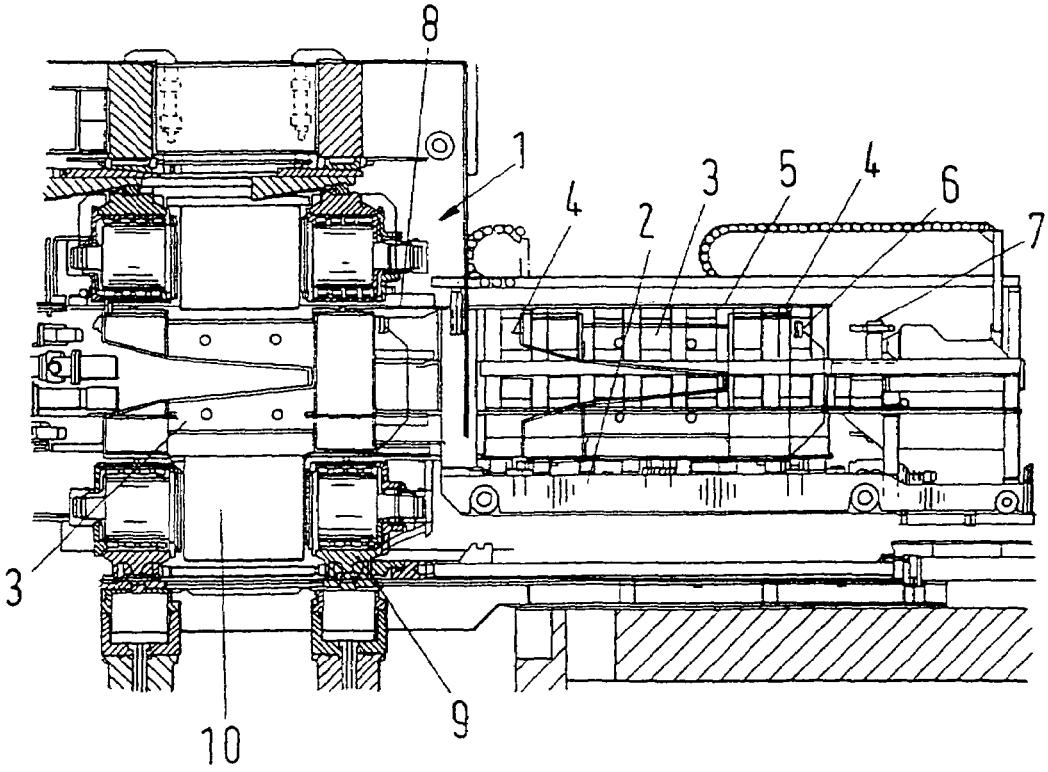
FIG. 1 shows a side view of a six-roll strip rolling stand during the changing of the backup rolls with the aid of the roll changing carriage and the removal crossbar.

Represented in a side view in FIG. 1 is a section taken centrally through a known six-roll strip rolling stand 1, in the case of which the set of rolls comprising work rolls and intermediate rolls has already been removed. The set of rolls was pulled out from the strip rolling stand 1 in a known way with the aid of the roll changing carriage 2 and displaced transversely, i.e. perpendicularly in relation to the plane of the drawing, on the roll changing carriage 2.

For the changing of the backup rolls, according to the invention the removal crossbar 3 is used. As FIG. 1 shows, this removal crossbar 3 is positioned on the roll changing carriage 2 laterally next to the set of rolls comprising work rolls and intermediate rolls, and was moved into a position centrally in relation to the strip rolling stand 1 by transverse displacement of the roll changing carriage 2. The set of rolls comprising work rolls and intermediate rolls cannot be seen in FIG. 1; it is concealed by the removal crossbar 3 in the foreground.

Figure 2:
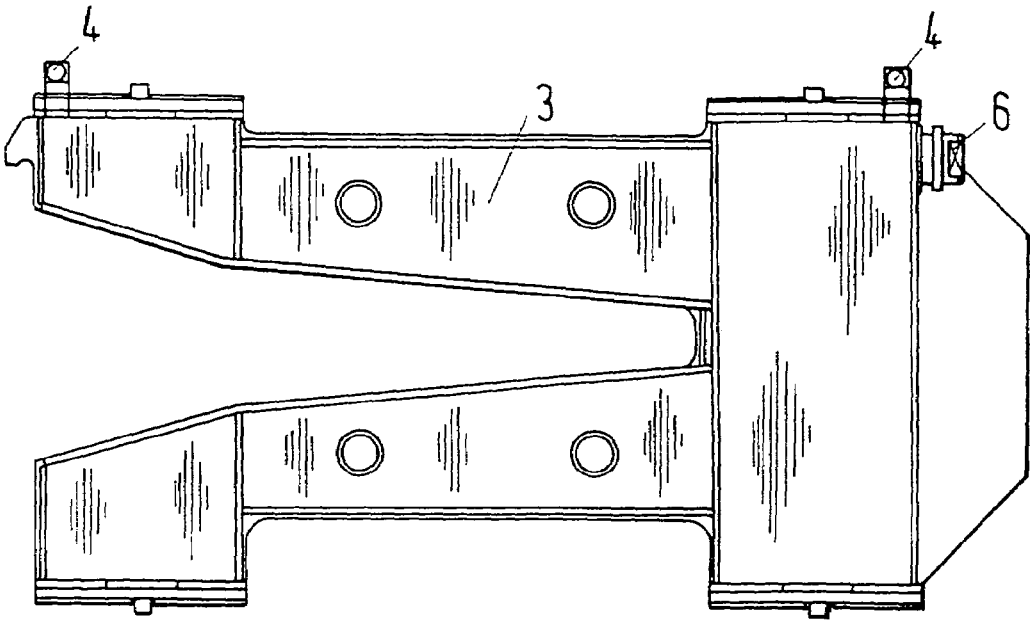
FIG. 2 shows the removal crossbar.

The roll changing carriage 2 with the removal crossbar 3 is ready for use in front of the strip rolling stand 1; the prepared removal crossbar 3 is suspended with wheels 4 on guide rails 5 of the roll changing carriage 2. As shown in the representation of a detail in FIG. 2 of the drawing, the removal crossbar 3 is designed in a C-shaped manner, so that the moving in and out of the removal crossbar 3 is also made possible when the strip is in the strip rolling stand 1. Arranged in each of the four upper corner regions of the removal crossbar are the wheels 4, with which the removal crossbar 3 is suspended in the guide rails 5 (FIG. 1) of the roll changing carriage 2. Attached on the side of the removal crossbar 3 that is on the right—in the plane of the drawing—is a roll pin 6, which, corresponding to the gripping device 7 of the roll changing carriage 2, makes it possible for the removal crossbar 3 to be automatically integrated in the changing of the backup rolls.

Figure 3:
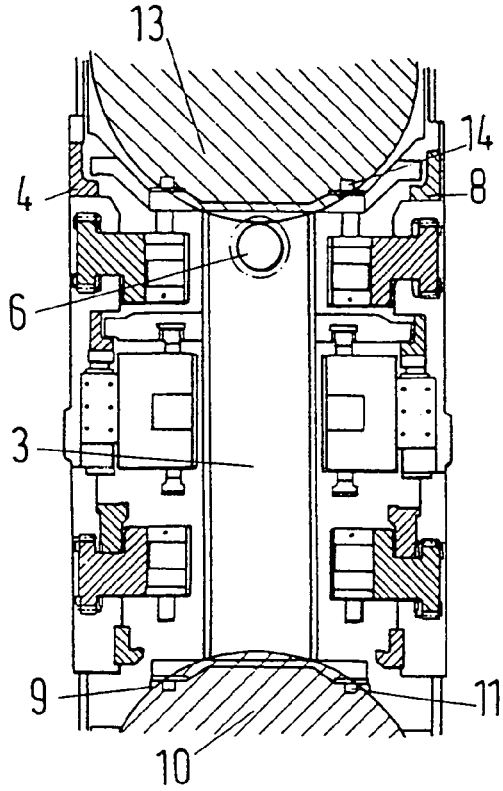
FIG. 3 shows a section through the strip rolling stand during the changing of the backup rolls with the upper backup roll placed on the removal crossbar and FIG. 4 shows a section through the strip rolling stand during the changing of the backup rolls with the removal crossbar raised.

In the left half of the drawing in FIG. 1, the removal crossbar 3 is represented in the strip rolling stand 1, where it fills the space of the removed set of rolls, comprising intermediate rolls and work rolls. Starting from the roll changing carriage 2, to bring the removal crossbar 3 from the preparation position represented in the right half of the drawing into the position in the strip rolling stand 1, represented in the left half of the drawing, the intermediate roll rails 8 of the same height in the strip rolling stand 1 and the guide rails 5 in the roll changing carriage 2 are brought into a position in which they are in line with one another. In this position, the removal crossbar 3 can be moved automatically from the roll changing device 2 via the guide rails 5 and the intermediate roll rails 8 into the strip rolling stand 1. By subsequent lowering of the intermediate roll rails 8, the removal crossbar 3 is lowered onto the chocks 9 of the lower backup roll 10 and set down there. This operation is represented in FIG. 3 of the drawing. Pins 11 on the underside of the removal crossbar 3 engage in bores 12 on the chock 9 and stabilize the removal crossbar 3. The no longer required roll changing carriage 2 is moved by transverse displacement to the side to such an extent that the window of the strip rolling stand 1 is free for changing the backup rolls.

Once the removal crossbar 3 has been set down, the upper backup roll 13 is hydraulically set down on top of the removal crossbar 3 and likewise secured by pins 15 engaging in bores 14 of the chocks 16. The entire set of backup rolls can then be moved out of the strip rolling stand 1 in a known way on the lower moving-out rails 17 (FIG. 1) and be changed manually with the aid of a crane (not represented).

Figure 4:
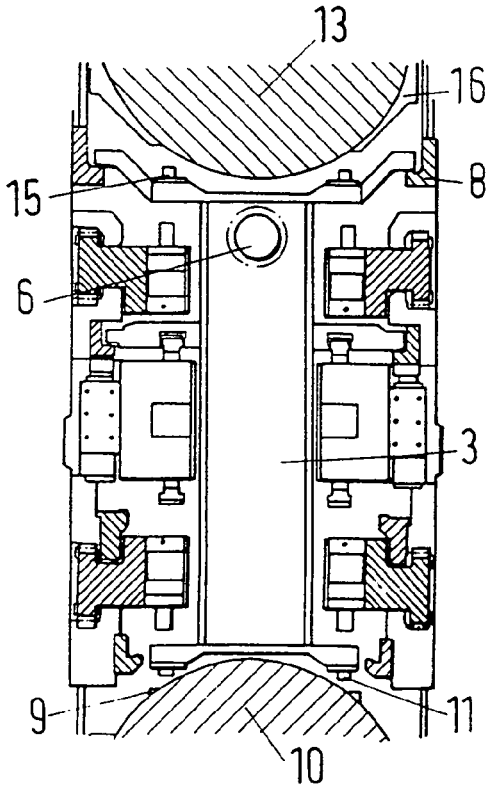

At the same time as the method sequence described above, the removed intermediate rolls and work rolls were replaced; a new set comprising intermediate rolls and work rolls was prepared on the roll changing carriage 2. A new set of backup rolls 10/13 is then moved into the strip rolling stand 1 in the reverse procedure to that described above for the removal of the old set of backup rolls. The backup rolls 10/13 are brought into position; the upper backup roll 13 is hydraulically raised, so that the chocks 16 are lifted off the removal crossbar 3. The removal crossbar 3 is lifted off the lower chocks 9 by means of the raised intermediate roll rails 8 and is then suspended freely from the intermediate roll rails 8 in the strip rolling stand 1, as represented in FIG. 4 of the drawing.

The roll changing carriage 2, which has in the meantime been transversely displaced into position, grips with its roll changing device 7 the roll pin 6 on the removal crossbar 3 and pulls the latter on the intermediate roll rails 8 and, via the aligned guide rails 5, out of the strip rolling stand 1 into the roll changing carriage 2.

By renewed transverse displacement of the roll changing carriage 2, the new set of rolls comprising intermediate rolls and work rolls, which is in the preparation position laterally next to the removal crossbar 3, is brought into a position centrally in relation to the strip rolling stand 1, from which the set of rolls can be moved into the strip rolling stand 1. This operation is conventional and therefore does not need to be described any further here. After closing the roll gap, the strip rolling stand 1 is ready for use.

What is claimed is:

1. An apparatus for changing sets of rolls in a stand of a strip rolling mill having at least one roll stand having a pair of work rolls for rolling a strip moving in a rolling direction, a pair of intermediate rolls, and a pair of backup rolls consisting of a lower backup roll and an upper backup roll, the apparatus comprising:

a roll changing carriage provided for changing of the work rolls and the intermediate rolls, the carriage being displaceable parallel to the rolling direction into a changing position aligned with a respective said roll stand, the carriage having guide rails extending parallel to the rolls and being movable parallel to the rolling direction into a set-up position in which the rolls can be replaced;

a removal crossbar having wheels for supporting the crossbar on the guide rails and moving the crossbar out of the carriage and into the roll stand between the backup rolls after the work rolls and the intermediate rolls have been removed, the wheels being mounted on both sides of an upper region of the crossbar, the crossbar being supportable on the lower backup roll and having means for supporting the upper backup roll so that the crossbar together with the backup rolls can be pulled out of the roll stand; and a pair of intermediate roll rails in the roll stand, the guide rails in the carriage aligning with the intermediate roll rails when the carriage is in the changing position, whereby the removal crossbar can be moved from the carriage into the roll stand, the intermediate roll rails being raisable and lowerable so that the crossbar can be supported on the lower backup roll.

2. The apparatus of claim 1, further comprising a pulling-out device mounted on the carriage, the crossbar having a roll pin which can be coupled to the pulling-out device.

3. The apparatus of claim 1, wherein the carriage can accommodate the work rolls and the intermediate rolls next to the crossbar in the direction of movement.

* * * * *